US005890761A

United States Patent [19]

Miller

[11] Patent Number: 5,890,761

[45] Date of Patent: Apr. 6, 1999

[54] PEW HAVING DISCRETE SEATING PORTIONS

[75] Inventor: Virgil Miller, Archbold, Ohio

[73] Assignee: Sauder Manufacturing Company, Archbold, Ohio

[21] Appl. No.: 885,414

[22] Filed: Jun. 30, 1997

[51] Int. Cl.[6] ..... A47C 11/07

[52] U.S. Cl. ..... 297/232; 297/440.22; 297/DIG. 6

[58] Field of Search ..... 297/232, 248, 297/249, 440.22, DIG. 6; D6/381

[56] References Cited

U.S. PATENT DOCUMENTS

| | | | |
|---|---|---|---|
| D. 221,642 | 8/1971 | Bayes . | |
| D. 221,644 | 8/1971 | Bayes . | |
| 3,584,916 | 6/1971 | Bayes . | |
| 3,796,459 | 3/1974 | Weber . | |
| 3,999,014 | 12/1976 | Bascom . | |
| 4,036,527 | 7/1977 | Faul | 297/232 X |
| 4,077,667 | 3/1978 | Allerheiligen . | |
| 4,568,124 | 2/1986 | Kanai | 297/440.22 |
| 4,655,504 | 4/1987 | Weber . | |
| 4,730,873 | 3/1988 | Janz | 297/232 X |
| 4,790,594 | 12/1988 | Temos | 297/440.22 X |
| 5,378,045 | 1/1995 | Sukman et al. | 297/DIG. 6 X |

OTHER PUBLICATIONS

Brochure for item #308–0150, armrest divider, published by Sauder Manufacturing Company, undated.

Specification Sheet 6–92 for Vantage chair, published by Sauder Manufacturing Company, undated.

Two photographs showing Combination Seating having a pew back and ends in combination with "theater type" seating, such seating manufactured by Sauder Manufacturing Company, undated.

P. 16 from Irwin Seating catalog, showing "theater type" seating, undated.

*Primary Examiner*—Peter R. Brown

*Attorney, Agent, or Firm*—Emch, Schaffer, Schaub & Porcello Co., L.P.A.

[57] ABSTRACT

A pew including a bench. At least two discrete seating portions are removably positioned on the bench. Each of the seating portions has a predetermined width.

5 Claims, 8 Drawing Sheets

PEW HAVING DISCRETE SEATING PORTIONS

BACKGROUND OF THE INVENTION

The present invention relates to a pew. More specifically, the invention is directed to a pew having discrete or individual seating portions.

A pew is one of the benches fixed in rows in a church. A pew provides seats for several persons. In the past, pews have consisted of long, continuous and undivided benches. Prior art pews have been both unpadded and padded. If the pews were padded, the padding corresponded to the long, continuous and undivided nature of the benches. The padding was fixedly attached to the benches. These prior art pews have created many problems. For example, the seating capacity of a prior art pew cannot be maximized because the long, continuous and undivided nature of the pew encourages persons occupying the pew to spread out along the pew instead of occupying only one seat. Further, individual seats cannot be numbered for concerts or special events to be held at the church in which the pew is placed. Prior art pews do not allow ushers or other attendants to easily identify an available seat or seats along the pew. Further, the selection of fabrics for prior art pew cushions is limited to, for example, solid fabrics because fabrics having, for example, stripes are difficult to match over the long, continuous and undivided length of the pew. It has also been found that it is difficult and expensive to repair or replace the fabric of prior art pew cushions.

In an attempt to overcome the above-identified problems associated with prior art pews, various alternatives have been developed. For example, a prior art pew body has been combined with a plurality of self-rising seats that include raised arm rests. These types of seats are known as "theater" seats. The problems associated with pews having theater seats are as follows: maintenance is difficult underneath the seats because the individual arm rests extend to the floor; arm rests make for cramped and confined seating for persons occupying the seats; theater seats are noisy, especially when persons rise from the seats; it is difficult for children to sit in theater seats; the mechanical devices used to make the seats self rising are difficult and costly to maintain; and theater seats are not aesthetically pleasing in traditional churches.

Another alternative to prior art pews has been the use of raised dividers that have been positioned along the back of a pew above the surface of the pew seat. These types of pews restrict the seating capacity of the pew to exactly the number of seats defined by the dividers because persons cannot sit on the dividers. Further, parishioners do not appreciate the "physical" division created by the individual dividers. Finally, these types of pews still retain the long and continuous nature of the seat thereby resulting in the fabric selection, repair and replacement problems described above.

Individual chairs have been used as an alternative to prior art pews. The chairs are usually separate. However, in some applications the chairs have been attached. While chairs are appropriate in some situations, it has been found that maintenance is difficult underneath the chairs because of the chair legs. Further, chairs are not aesthetically pleasing in churches where traditional pews are desired.

In view of the foregoing, it has been found that there is a clear need for a pew having discrete seating portions wherein each of the seating portions has a predetermined width that defines an individual seat. The present invention satisfies this need.

SUMMARY OF THE INVENTION

The present invention is directed to a pew having a bench. At least two discrete seating portions are removably positioned on the bench. Each of the seating portions has a predetermined width.

The primary object of the present invention is to provide a pew that maximizes seating capacity.

An important object of the present invention is to provide a pew that allows ushers or other attendants to identify an individual seat or seats.

Another important object of the present invention is to provide a pew that allows for the numbering of individual seats.

Another important object of the present invention is to provide a pew that allows for the use of a wide variety of fabrics.

Another important object of the present invention is to provide a pew having individual seats that can be easily and inexpensively repaired or replaced.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
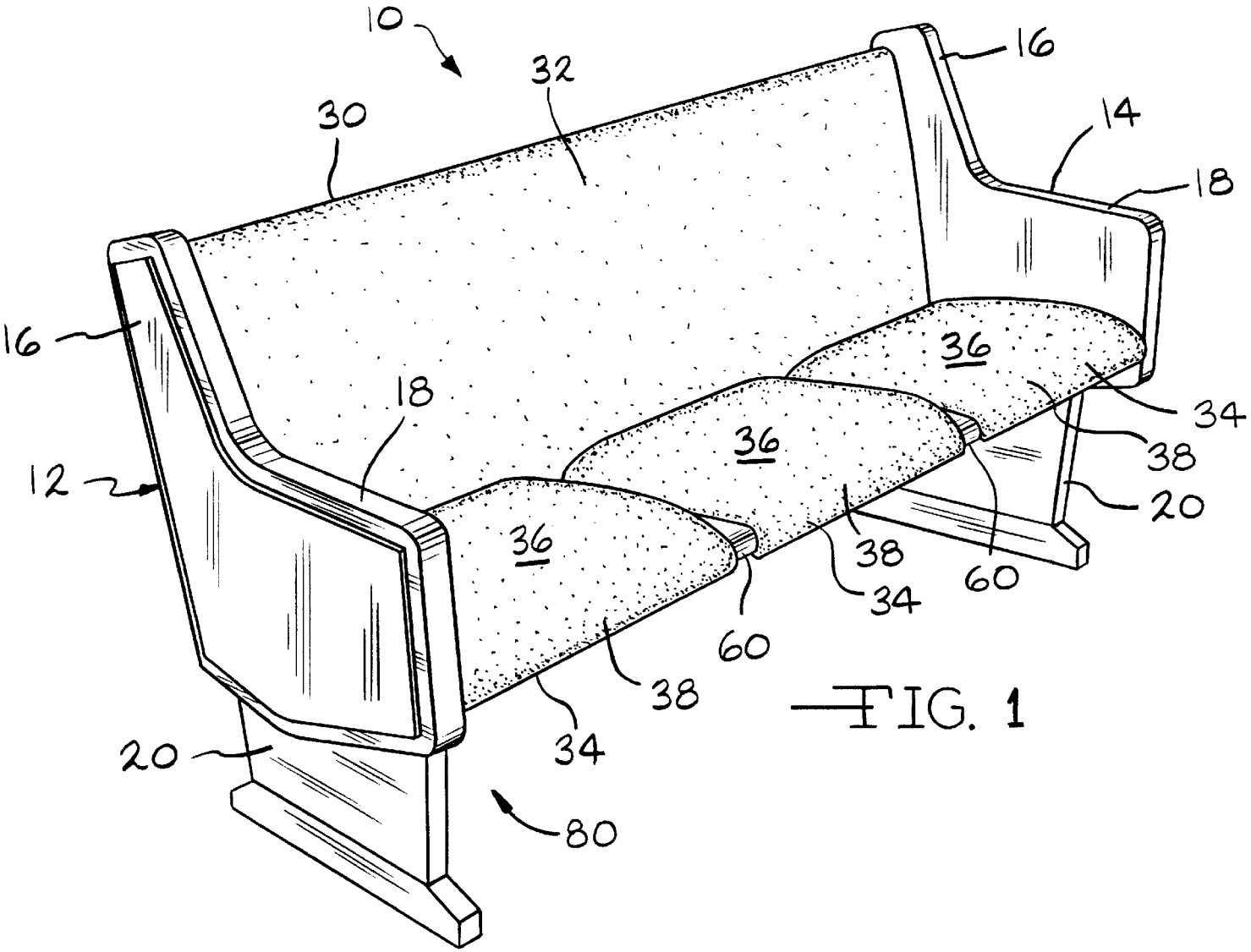
FIG. 1 is a perspective view of a pew according to the present invention.

The preferred embodiments and best mode of the present invention will now be described in detail with reference being made to the drawings. The pew of the present invention is indicated generally in the drawings by the reference number "10".

Referring to FIGS. 1, 3, 4 and 6, the pew 10 includes a first end 12 and a second end 14. The first and second ends 12 and 14 can be comprised of a variety of shapes and designs depending on the particular application of the pew 10. In the present embodiment, the first and second ends 12 and 14 each includes a top portion 16 and an arm portion 18. The pew 10 further includes a pair of pew supports 20. The first and second ends 12 and 14 and pew supports 20 can be made of a variety of materials, with wood being preferred.

Figure 3:
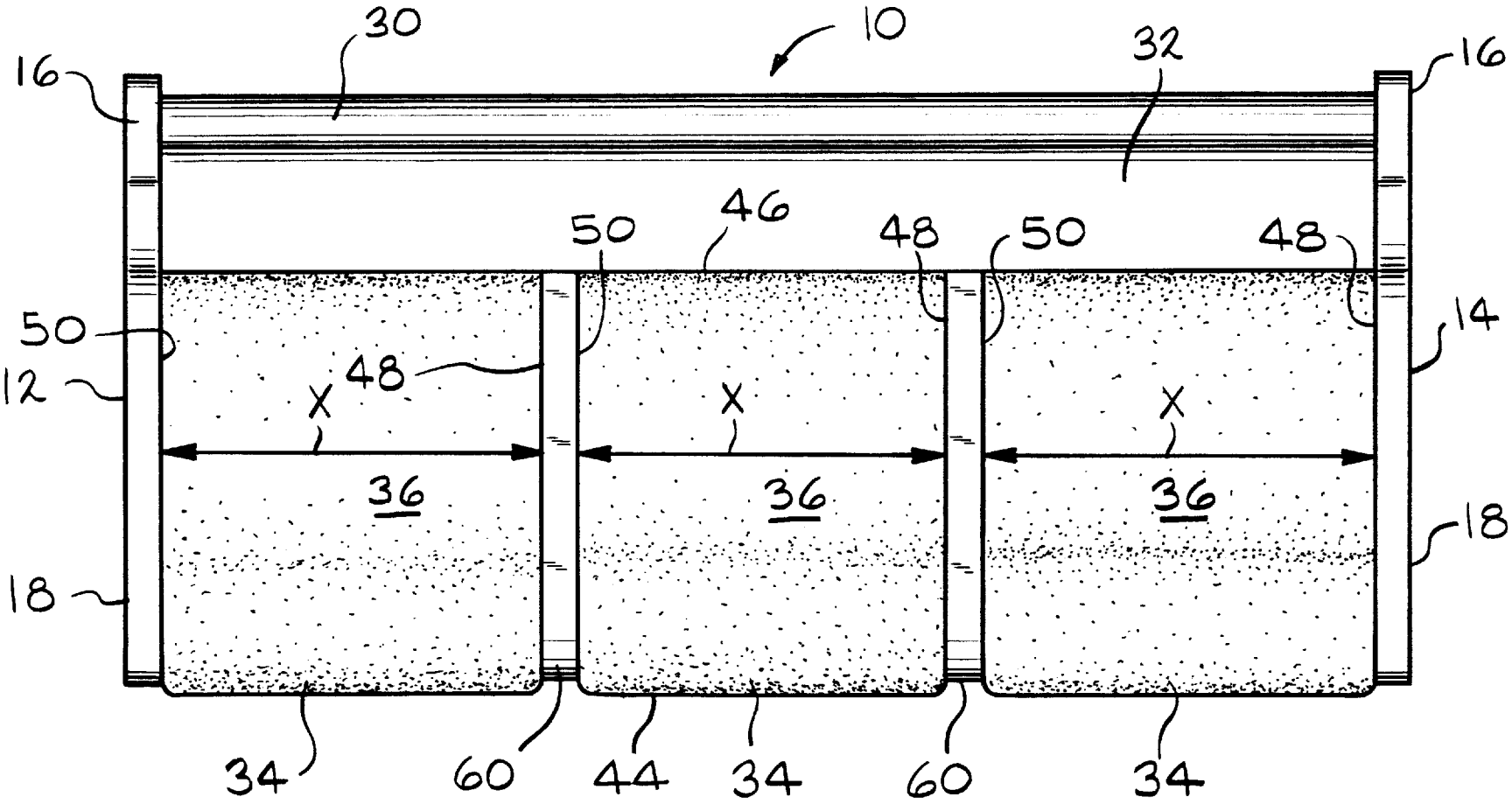
FIG. 3 is a plan view of the embodiment of the invention shown in FIG. 1.
Figure 4:
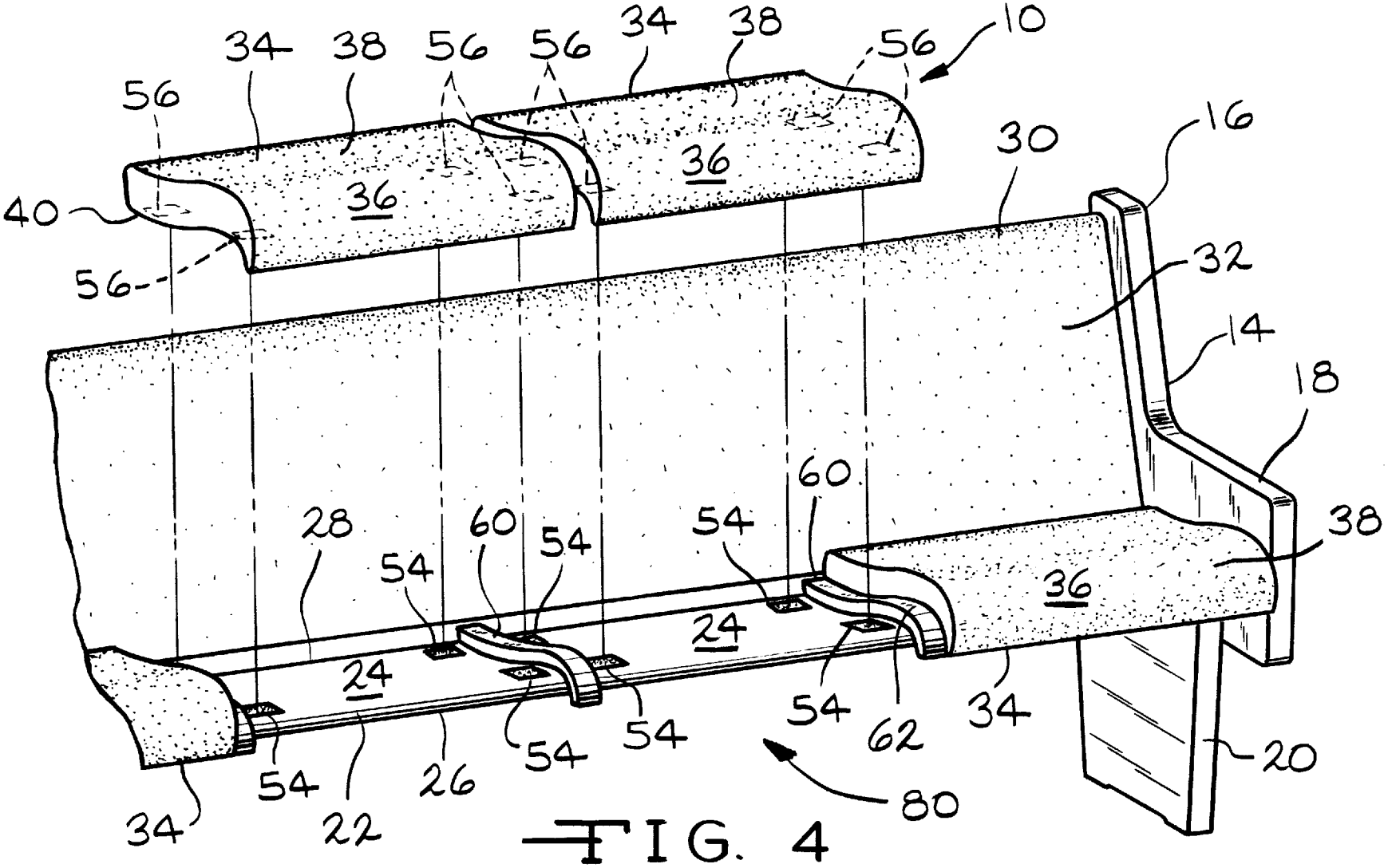
FIG. 4 is a perspective exploded view showing the positioning of the discrete seating portions on the bench of the present invention.
Figure 5:
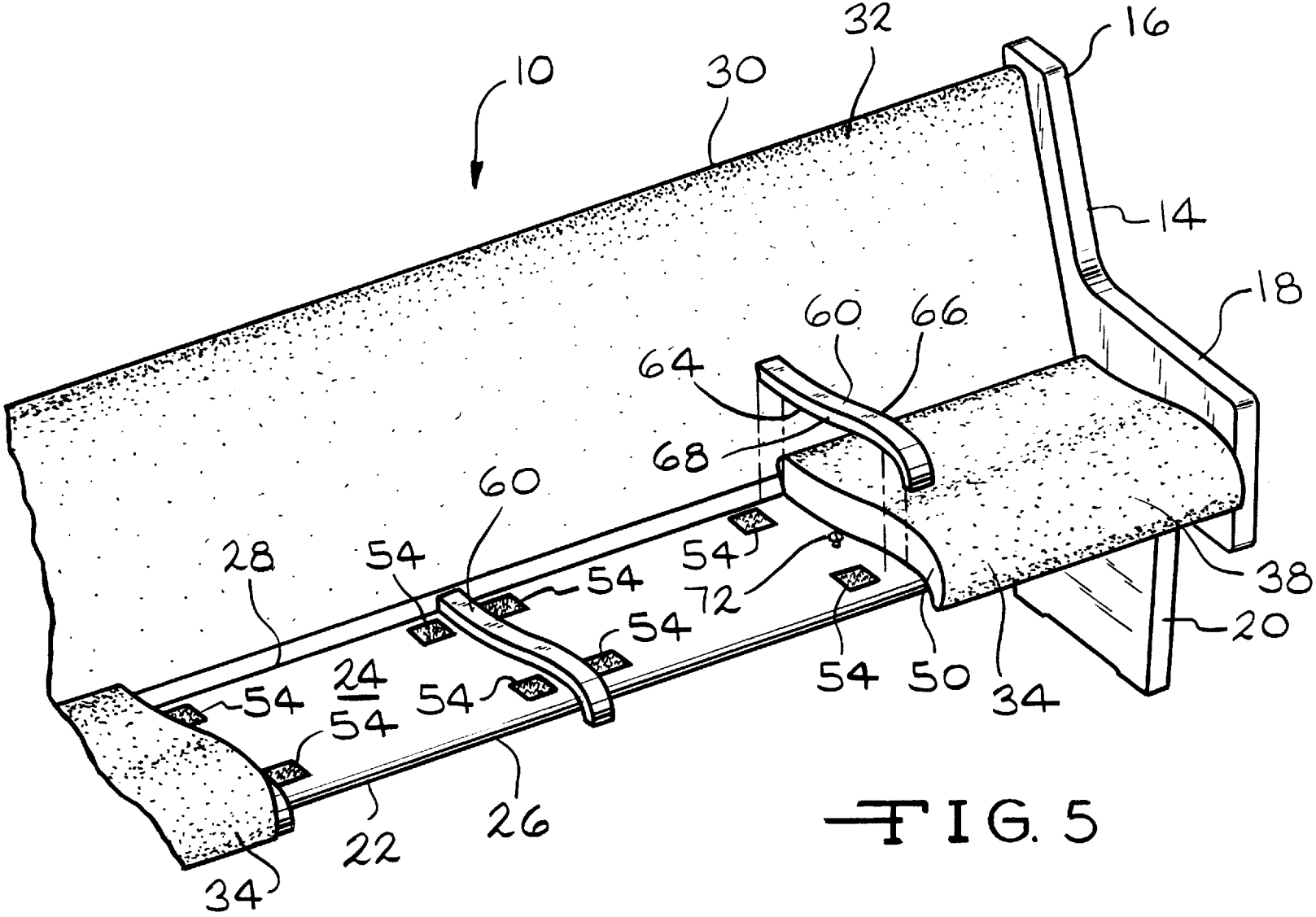
FIG. 5 is a view similar to the view of FIG. 4 showing the positioning of the dividers on the bench of the present invention.

As shown in FIG. 4, the pew 10 includes a bench 22 that extends longitudinally between the first and second ends 12 and 14. The bench 22 includes a bench surface 24 having a front portion 26 and a back portion 28. Referring again to FIGS. 1, 3, 4 and 6, the pew 10 includes a back 30 that extends longitudinally between the first and second ends 12 and 14 and is positioned adjacent the back portion 28 of the bench surface 24. The shape and design of the back 30 can vary depending on the application of the pew 10. In the present embodiment, the back 30 is generally rectangular in shape. The back 30 can include a cushion covered by fabric 32. The back 30 can also be constructed of a wood veneer (not shown).

Referring now to FIGS. 1–4, the pew 10 includes at least two discrete or individual seating portions 34. As shown in FIG. 1, the pew 10 has three seating portions 34. However, it should be understood that the number of seating portions 34 can vary depending on the application of the pew. For example, if the pew is large, such as the one shown in FIG. 4, there can be four or more seating portions 34.

As shown in FIGS. 1, 3, 4 and 6, a seating portion 34 includes a seat surface 36 covered with a fabric 38, a bottom surface 40 that is usually constructed of a laminated hardwood sheet, a center portion 42 that usually consists of a foam cushion, a front edge 44, a back edge 46, a first side 48 and a second side 50. The seat surface 36 of the seating portions 34 is shaped to have a body contour to provide a comfortable seat for a person. The front edges 44 of the seating portions 34 include curved or "waterfall" shapes to provide maximum comfort for the persons seated on the seating portions. A wide variety of fabric patterns can be used for the fabric 38, including, for example, striped, floral and paisley patterns. It should be understood that other shapes and styles can be utilized depending on the application of the pew 10.

Referring to FIG. 4, the discrete seating portions 34 are removably positioned on the bench surface 24 of the bench 22 by fastening means. In the preferred embodiment, the fastening means includes synthetic materials which adhere when pressed together, such as material sold under the trademark VELCRO®. However, it should be understood that other fastening means can be used in the present invention to removably position the seating portions 34 on the bench surface 24, such as conventional screws, bolts, clips or the like. In the present embodiment, as shown in FIG. 4, four portions of synthetic material 54 are positioned on the bench surface 24 for each seating portion 34. In the preferred embodiment, two portions of synthetic material 54 are positioned on the front portion 26 of the bench surface 24 and two portions of synthetic material 54 are positioned on the back portion 28 of the bench surface 24. Accordingly, four portions of synthetic material 56 are positioned on the bottom surface 40 of each seating portion 34 in an arrangement that corresponds to the arrangement of the synthetic material portions 54 on the bench surface 24. When so arranged, the synthetic material portions 54 of the bench surface 24 and the synthetic material portions 56 of the bottom surface 40 are in mating engagement. This provides for a firm attachment of the seating portion 34 to the bench 22. However, the seating portions 34 can be easily removed from the bench 22 for repair, replacement, or maintenance of the seating portions.

Referring to FIGS. 1–8, the pew 10 includes at least one divider 60. The divider 60 is positioned between two discrete seating portions 34. In the embodiment of the invention shown in FIG. 1, the pew 10 includes two dividers 60. However, it should be understood that the number of dividers 60 depends on the number of seating portions 34. For example, if there are ten seating portions 34, the pew 10 would include nine dividers 60.

Figure 8:
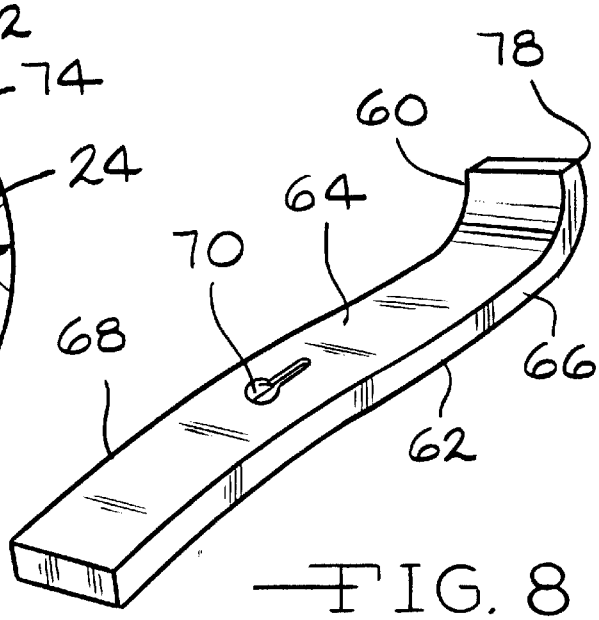
FIG. 8 is a perspective view of the bottom surface of the divider according to the present invention.

As shown in FIG. 8, a divider 60 includes a top surface 62, a bottom surface 64, a first edge 66 and a second edge 68. In the preferred embodiment, the divider 60 has a predetermined width of 1.5 inches (3.8 cm) as measured from the first edge 66 to the second edge 68. It should be understood that the predetermined width of the divider 60 can vary depending on the application of the pew 10.

As shown in FIGS. 5–8, the bottom surface 64 of the divider 60 includes a key-hole slot 70. The divider 60 is attached to the bench surface 24 of the bench 22 by a threaded screw 72 having a head 74 and a threaded portion 76. The threaded portion 76 is received by the bench surface 24. The head 74 is received by the key-hole slot 70 of the divider 60. An adhesive can be used to fixedly attach the divider 60 to the bench surface 24. It should be understood that other attachment means can be used to attach the divider 60 to the bench surface 24. For example, mating synthetic materials which adhere when pressed together, such as VELCRO®, can be used to attach the divider 60 to the bench surface 24 (not shown).

Figure 2:
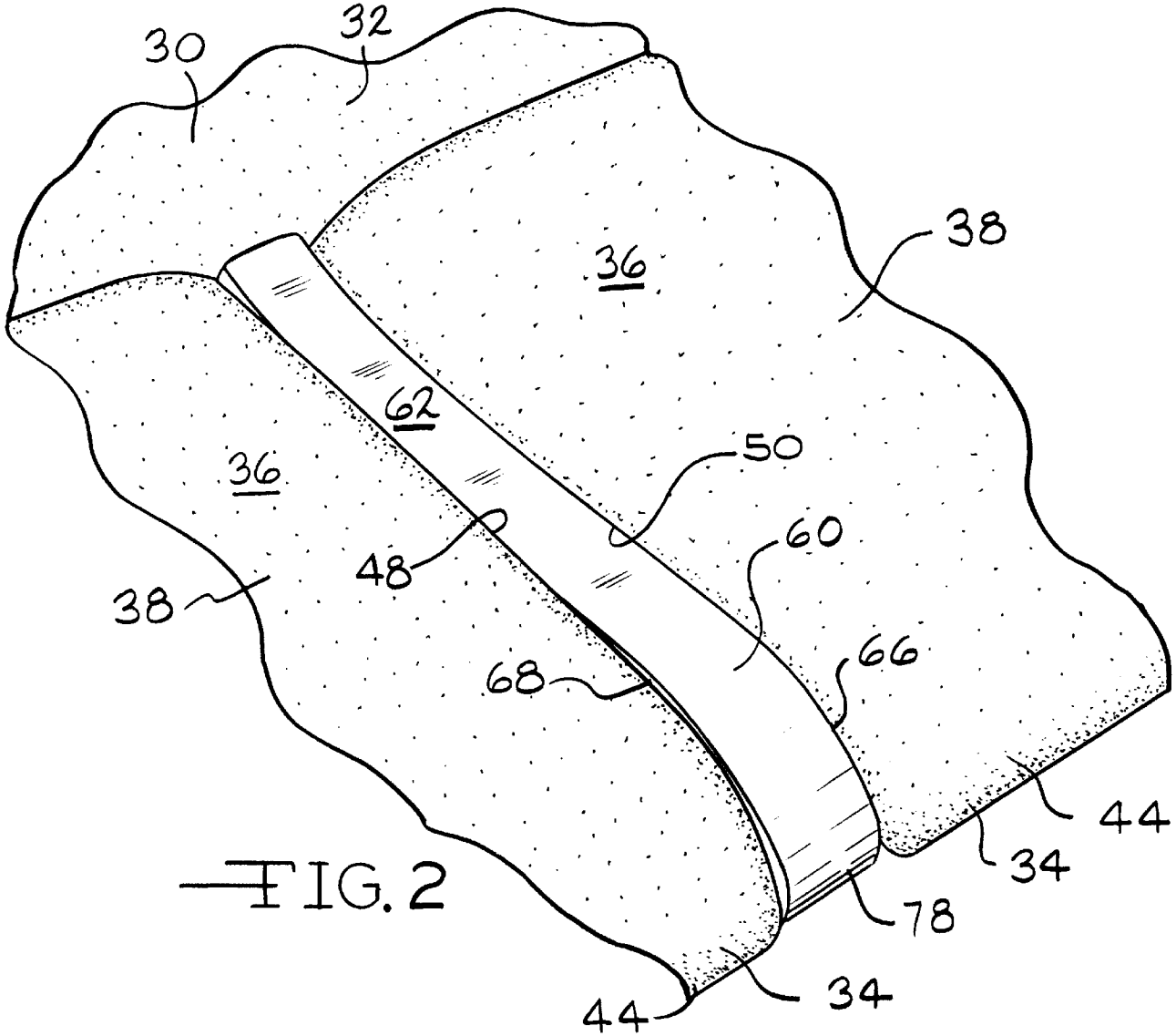
FIG. 2 is a detailed view of a divider positioned between two discrete seating portions of the embodiment of the invention shown in FIG. 1.

The divider 60 is constructed of laminated hardwood. The divider 60 can be formed to correspond to the shapes of the seating portions 34. For example, as shown in FIG. 2, the divider 60 can include a waterfall front 78 that corresponds to the waterfall shapes of the front edges 44 of the seating portions 34. The divider 60 can have a finish similar to the finish used for the first and second ends 12 and 14 and other exposed wood surfaces of the pew 10.

Referring to FIGS. 1, 2, 4 and 6, a divider 60 is positioned between two seating portions 34. As shown in FIG. 2, the first edge 66 of the divider 60 is positioned immediately adjacent the second side 50 of one seating portion 34 and the second edge 68 of the divider 60 is positioned immediately adjacent the first side 48 of another seating portion 34.

Figure 6:
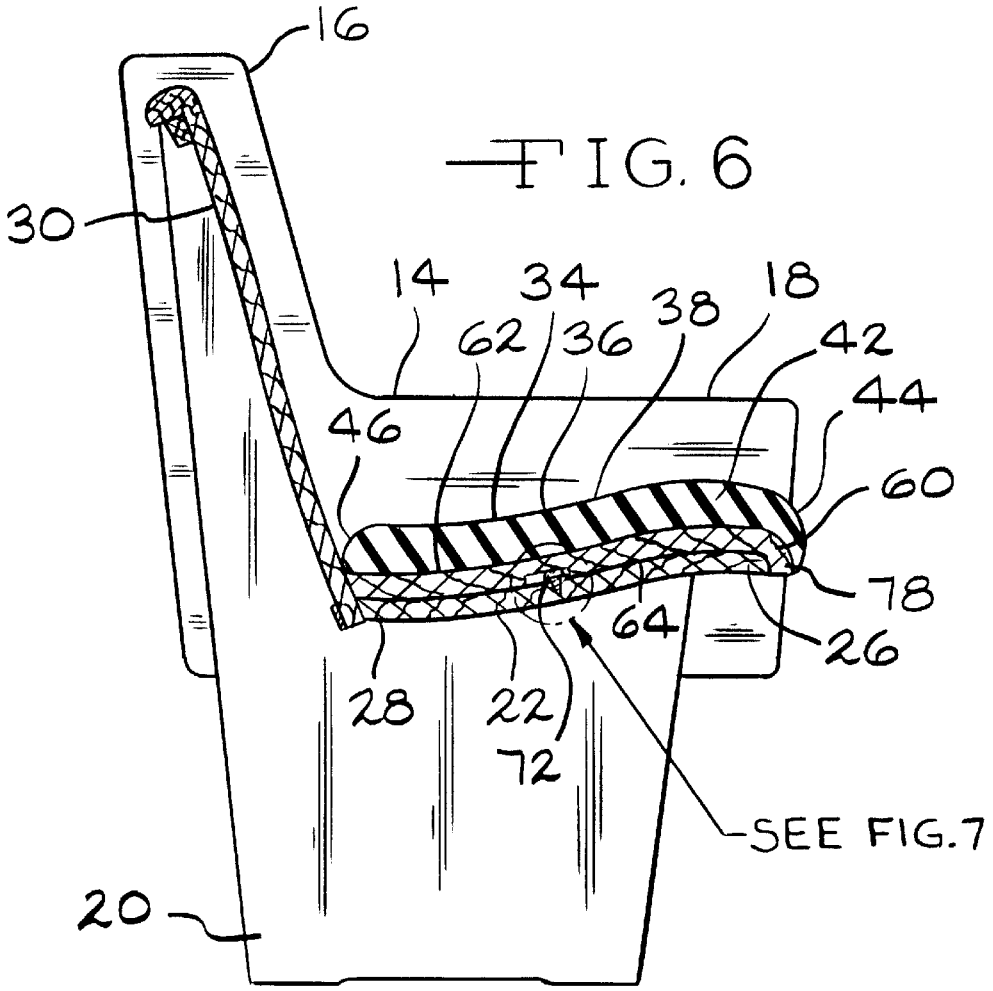
FIG. 6 is a cross-sectional view taken through the center of the embodiment of the invention shown in FIG. 1.
Figure 7:
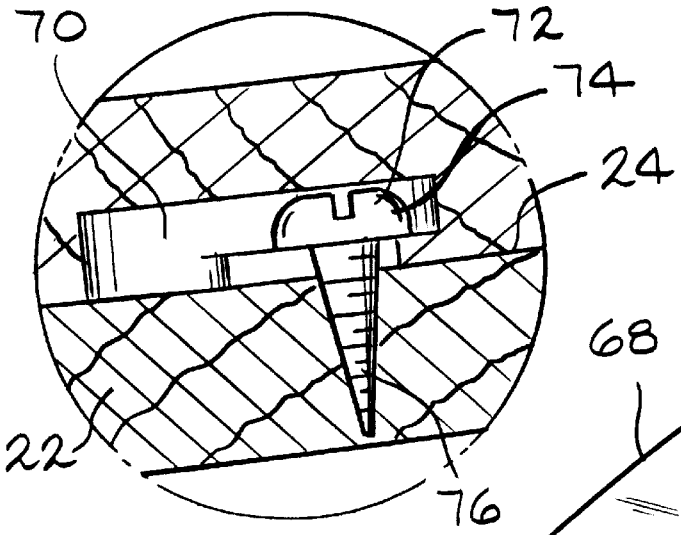
FIG. 7 is a detailed view as indicated in FIG. 6.

As shown in FIGS. 4 and 6, the top surface 62 of the divider 60 is positioned below the seat surfaces 36 of the seating portions 34. In rid other embodiments, the top surface 62 of the divider 60 can be at the same level as the seat surfaces 36 of the seating portions 34. This arrangement eliminates any physical barriers along the length of the pew 10 that would prevent a person from sitting on a divider 60 if necessary. As shown in FIG. 1, the dividers 60 do not extend downwardly from the bench 22. This allows for an open space 80 below the pew 10 that is easy to maintain.

Referring to FIG. 3, each discrete seating portion 34 has a predetermined width X, which is measured from the first side 48 to the second side 50. In a preferred embodiment, as shown in FIG. 3, the predetermined width X of a seating portion 34 is in the range from about 15 inches (38.1 cm) to about 24 inches (61.0 cm). For example, the predetermined width X of a seating portion 34 can be 17.5 inches (44.5 cm), 18.5 inches (47 cm), 19.5 inches (49.6 cm), or 20.5 inches (52.1 cm). As stated above, the predetermined width of a divider 60 is 1.5 inches (3.8 cm). For these specific examples, the predetermined widths of the seating portions 34 and the dividers 60 allow for individual seating areas along the length of the pew 10 of 19 inches (48.3 cm), 20 inches (50.8 cm), 21 inches (53.3 cm), or 22 inches (55.9 cm), respectively, as measured from the center of one divider to the next divider. The predetermined width X of the seating portion 34 is an important feature of the present invention because it has been found that the predetermined width can accommodate an average-sized adult. Further, the predetermined width X ensures proper spacing of the seating portions 34 along the entire length of the bench 22 of the pew 10.

The discrete seating portions 34 as defined by the dividers 60 allow for maximum seating capacity in the pew 10. The seating portions 34 can be numbered for concerts or other special events to be held at the church in which the pew 10 is placed. The individual seating portions 34 allow ushers or other attendants to easily identify an available seat or seats along the pew 10. Finally, the seating portions 34 and dividers 60 provide a pew 10 that is aesthetically pleasing.

Figure 9:
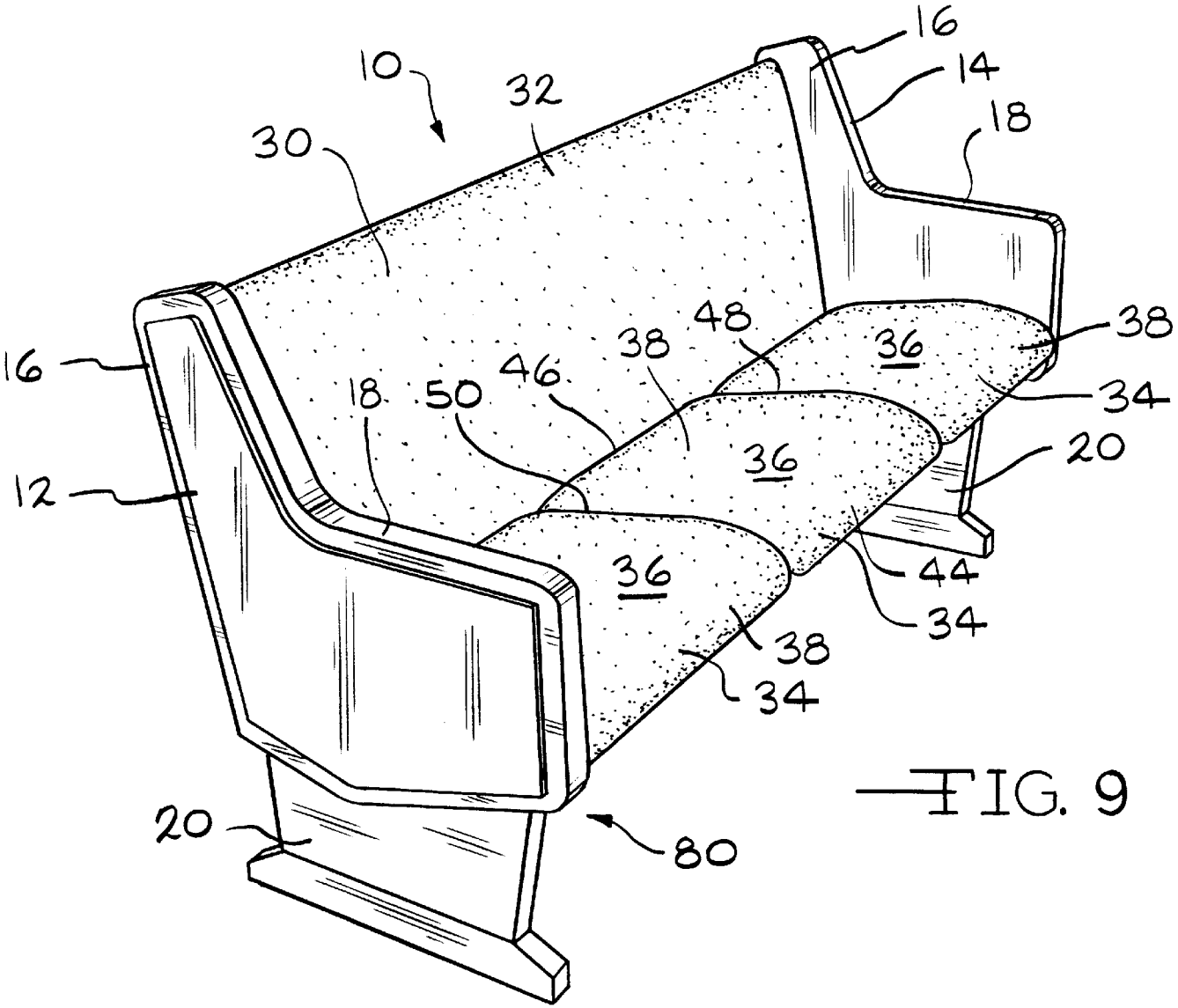
FIG. 9 is a perspective view of an alternative embodiment of the pew according to the present invention.
Figure 10:
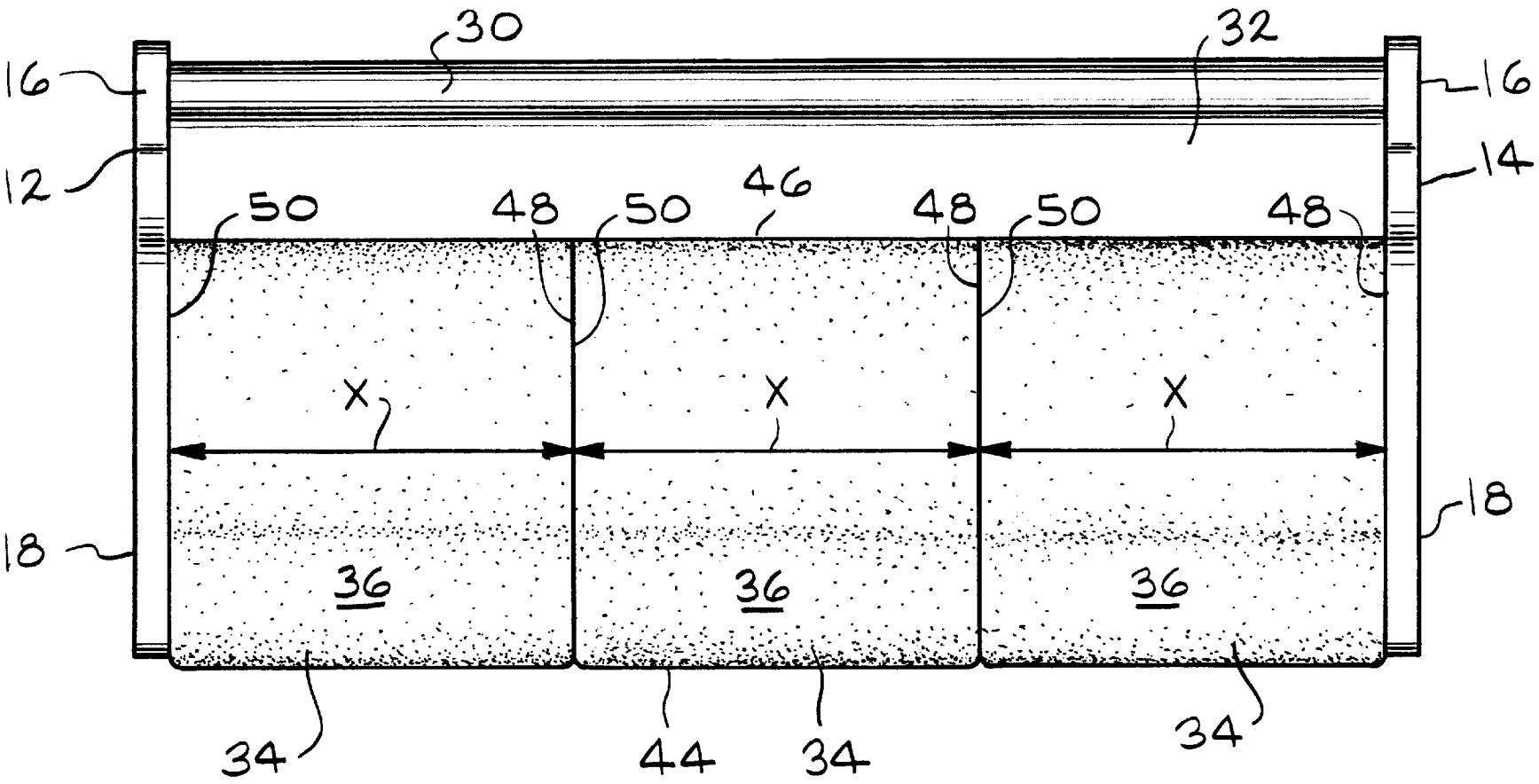
FIG. 10 is a plan view of the embodiment of the invention shown in FIG. 9.

An alternative embodiment pew 10 according to the present invention is shown in FIGS. 9 and 10. The alternative embodiment includes all of the elements and advantages described above for the first embodiment pew 10 shown in FIGS. 1–8, with the exception of the dividers 60. In the alternative embodiment, as shown in FIGS. 9 and 10, the discrete seating portions 34 are positioned immediately adjacent one another wherein the first side 48 of one seating portion 34 is adjacent the second side 50 of another seating portion 34. However, since the seating portions 34 have predetermined widths X, they present an appearance of being separate seats. As shown in FIG. 10, the predetermined width X of a seating portion 34 in the alternative embodiment as measured from the first side 48 to the second side 50 is in the range from about 15 inches (38.1 cm) to about 24 inches (61.0 cm). For example, the predetermined widths X can be 19 inches (48.3 cm), 20 inches (50.8 cm), 21 inches (53.3 cm), or 22 inches (55.9 cm). For these specific examples, the predetermined widths of the seating portions 34 allow for individual seating areas along the length of the pew 10 of 19 inches (48.3 cm), 20 inches (50.8 cm), 21 inches (53.3 cm), or 22 inches (55.9 cm), respectively. As stated above, the predetermined width X of the seating portion 34 is an important feature of the invention.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, with the scope of the invention being defined solely by the appended claims.

I claim:

1. A pew having a first end and an opposed second end, each of said first and second ends including a top portion and an arm portion, said pew further including a continuous bench extending longitudinally between said first and second ends, said pew further including a continuous back portion extending longitudinally between said first and second ends adjacent said bench, said pew further including at least two discrete seating portions being removably positioned on said bench by fastening means, each of said seating portions including a seat surface, a first side and a second side, each of said seating portions having a first predetermined width defined by said first and second sides, said pew further including at least one divider positioned on said bench, said divider including a top surface, a bottom surface, a first edge and a second edge, said divider having a second predetermined width defined by said first and second edges, said bottom surface being attached to said bench, said first edge being positioned immediately adjacent said second side of one of said seating portions and said second edge being positioned immediately adjacent said first side of another said seating portion, said top surface being at or below said seat surfaces of said seating portions, whereby each of said seating portions provides an individual seat for a person seated in said pew.

2. The pew of claim 1 wherein said pew is supported by at least one support member positioned adjacent said bench.

3. The pew of claim 1, wherein said fastening means includes synthetic materials which adhere when pressed together positioned on said bench and on said seating portions in mating engagement.

4. The pew of claim 1, wherein said first predetermined width of each of said seating portions is in the range from about 15 inches (38.1 cm) to about 24 inches (61.0 cm), and said second predetermined width of said divider is substantially 1.5 inches (3.8 cm).

5. The pew of claim 1, wherein said bench includes at least one fastening device, said bottom surface of said divider defining a slot adapted to receive said fastening device to attach said divider to said bench.

* * * * *